United States Patent [19]

Bosch et al.

[11] 4,159,455

[45] Jun. 26, 1979

[54] ELECTROMAGNETIC MINIATURE RELAY

[75] Inventors: Werner Bosch, Munich; Georg Aigner, Ebersberg, both of Fed. Rep. of Germany

[73] Assignee: Siemens Aktiengesellschaft, Berlin & Munich, Fed. Rep. of Germany

[21] Appl. No.: 816,965

[22] Filed: Jul. 19, 1977

[30] Foreign Application Priority Data

Jul. 27, 1976 [DE] Fed. Rep. of Germany ..... 2633734

[51] Int. Cl.[2] ..... H01H 51/22

[52] U.S. Cl. ..... 335/79; 335/81; 335/230

[58] Field of Search ..... 335/78, 79, 80, 81, 335/84, 85, 229, 230, 202

[56] References Cited

U.S. PATENT DOCUMENTS

| | | | |
|---|---|---|---|
| 3,800,251 | 3/1974 | Usui et al. | 335/202 |
| 3,993,971 | 11/1976 | Ono et al. | 335/78 X |
| 4,075,585 | 2/1978 | Sauer | 335/78 |

*Primary Examiner*—George Harris

*Attorney, Agent, or Firm*—Hill, Van Santen, Steadman, Chiara & Simpson

[57] ABSTRACT

A miniature electromagnetic relay is disclosed having a two-piece coil supporting body, one piece of which constitutes a main body portion defining an internal switching space containing a moving armature and associated components together with contact switching members. Guide channels are provided in the main body portion allowing insertion of the switching components from a direction normal to the plane of movement of the armature. A second body portion closes the switching space. Various configurations are illustrated.

34 Claims, 8 Drawing Figures

ELECTROMAGNETIC MINIATURE RELAY

BACKGROUND OF THE INVENTION

1. Field of the Invention

This invention relates to electronic devices and more particularly to an electromagnetic miniature relay.

2. Prior Art

This invention is directed to electromagnetic miniature relays of the type which have a coil body consisting of at least two parts which cooperate to define a switching space enclosed by the parts with the switching space containing the contact making components of the relay and, further, where a main one of the body parts primarily forms at least one switching chamber which may be closed by means of a covering body part and carries the magnet system and contact elements.

In a known relay of this type (as for example that shown in British Pat. No. 1,456,861 and German Auslegeschrift No. 2,318,812) the contact elements, i.e. contact terminal carrying springs and stationary counter contact carrying members, are firmly embedded into one portion of the coil body in an integral fashion. That is, in the known relays the contact elements are injected or otherwise impressed into the material of the coil body part during the production of the coil body part, generally by means of an injection molding process. This type of construction necessitates a high production cost since unlike the coil winding terminals, the contact terminal carrying elements must be precisely positioned. Further, production of a component of this type where the contact elements are injected is complicated by the fact that the contact springs must first be welded to the terminal pins therefore. This necessitates both special equipment and expensive assembly procedures.

SUMMARY OF THE INVENTION

It is therefore a principle object of this invention to provide a miniature relay which is suitable for circuit board assembly and is substantially sealed and in which a simple construction concept facilitates component production and simplicity of assembly while permiting assembly employing different numbers of contact sets.

This principle object is accomplished in connection with a miniature relay of the type previously referred to by providing that in the region of the switching space the main coil body portion is equipped with guide channels into which parts of the magnet system and the contact assembly can be inserted from a side of the main body portion. The direction of insertion is at a right angle to the plane of armature movement.

Therefore relays constructed according to the principles of this invention will have both the elements of the magnet system such as the armature and flux plates and the contact units which include both movable contact carrying elements and stationary contact elements secured in the main body portion in a plug-in type assembly operation. As a result of this simple plug-in concept, the main body portion can be produced as a relatively simple, inexpensive, injection molded component requiring only molded-in-place coil terminals which do not present problems of high accuracy placement. Further, the parallel insertion movement of the armature on the one hand and the contact carrying units on the other hand in a direction perpendicular to the plane of the armature movement assures that the components will inevitably assume the correct position vis-a-vis one another without, however, requiring accuracy of depth of insertion. Preferably the inserted components are held in position by a force fit and are additionally maintained in secured position by the coil body second part or cover. Thus the combination of the coil body parts, i.e. the main portion and the cover portion, together define a sealed contact chamber or switching space while at the same time externally defining a completed coil body to which the winding can thereafter be applied.

If desired, one or more coil winding terminals can be injected into the cover portion of the coil body. Other than that, however, the main body portion is the sole carrier of all of the functioning elements such that following assembly of the components interior of the main body portion, even without the use of a coil winding, the functioning of the relay can be checked with the aid of an external magnetic field. In this open state of the main body portion it is possible to easily adjust the contact members should such adjustment be warranted.

In the assemblies described herein the contact unit will itself preferably consist of an insulating block member into which at least one contact tipped spring forming a movable contact spring and one stationary contact tipped member are formed during the injection molding process. Normally contact carrying units of this type contain a change-over switch which comprises one stationary central contact and two moving contact springs or alternatively one moving central contact spring and two stationary counter contacts.

The contact elements of the individual contact carrying units are preferably aligned in a row in the direction of insertion into the insulating block and are offset from one another within the switching chamber so that they overlap one another in the desired manner at the contact point. In one particular embodiment of the invention, the guide channel for receipt of the contact unit is contoured in the base wall of the main body which faces the terminal side. In this manner all of the terminals will project from the base wall. In other applications, however, it may be desired to position the contact carrying unit guide channel in an end or side wall of the main body in which case the terminal pins will be bent towards the terminal side of the main body exterior of the main body.

One prime advantage of the above-described concept is that it is not restricted to single contact unit relays but can be extended to relays using a plurality of contact units without, however, changing the insertion principles. Such an extension to multi-contact unit relays requires only minor construction modifications while allowing construction of the contact units as identical members. Thus, in one described embodiment of the invention, two contact units can be plugged into separate guide channels of a common switching chamber in spaced parallel relation with one another and with the free ends of the contact springs positioned essentially parallel to the coil access but opposed to one another. This allows the contacts of both units to be actuated by a common armature positioned between them.

It is also possible to increase the number of contact units by aligning a multiplicity of contact units in series for insertion in a common guide channel. In such a situation, however because later received contact units will partially block access to earlier received contact units, it is expedient to individually insert and adjust each contact unit and to thereafter insert the next contact unit.

Further, the versatility of this invention can be increased by modifying the main body such that it includes two adjacent switching chambers which can be provided with their individual components from opposite sides and which each have separate guide channels. Each of the separate switching spaces can be closed by a separate cover portion whereby the overall coil winding body may for example comprise a three piece body with a central main body portion defining two switching spaces each open from an opposite side of the main body and the main body being closed along the opposite sides by two separate cover portions. Thus by means of more or less extensive development of the main body, it is possible to produce relays comprising one, two, four, six or even more contact carrying units while always retaining the same fundamental principle in respect to the construction of the overall relay and the design and assembly of the contact carrier units.

Because of the plug-in construction of the components of the relay of this invention, the magnet system of the relay will also consist of a few simple components which will fundamentally remain the same regardless of the number of contacts employed. In a preferred embodiment of the invention, the magnet system consists of two pole plates which are inserted into guide channels defined in the switching space of the main body portion. The pole plates have internal spaced apart ends which approach each other in a V shape configuration and which, in an extension of the pole plate provide a knife edge bearing for support of an approximately V shaped rocker armature. When a polarized relay is desired, a permanent magnet will be arranged between the two ends of the pole plates, the permanent magnet having an approximately triangular cross section whose projecting angle edge forms the knife edge bearing for the armature. That edge has a first polarity and the remaining two angle edges of the triangular magnet which contact the pole plates will have the opposite polarity.

On the other hand, if a non-polarized relay is to be provided, in place of the aforementioned permanent magnet, a nonmagnetic structure corresponding to the shape of the permanent magnet can be provided. In such a modification one of the pole plates may be extended to provide the knife edge bearing. If desired, the armature can be spring pressed against the knife edge bearing and if further desired, return spring can be provided to define the rest position of the armature. One of the contact springs or a component extending from a contact spring can be used for this later purpose.

In those constructions which comprise two switching spaces which are positioned parallel to one another in the main body portion, a common armature can be expediently utilized which penetrates a partition wall between the switching spaces. In such a construction the pole plates can be separately provided for each of the switching spaces. If the two switching chamber constructions is a polarized construction, a continuous common permanent magnet can also be used for both of the switching chambers.

In all embodiments, it is preferred to utilize a single flux guide plate which extends over the coil winding exterior of the main body portion and which is applied following closure of the switching space and winding of the coil. The flux plate contacts end portions of each of the pole plates. It is further advantageous to provide the completed relay with an insulating cap and to seal it by means of a sealing compound.

It is therefore an object of this invention to provide an improved miniature electromagnetic relay design.

It is another, and more important object of this invention to provide a miniature electromagnetic relay which has a coil winding body formed of a base body portion and a cover portion with the base body portion primarily defining an interior switching space into which components of the switching system can be inserted from an open side of the main body portion, the interior switching space being provided with guide channels for receipt of the components.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
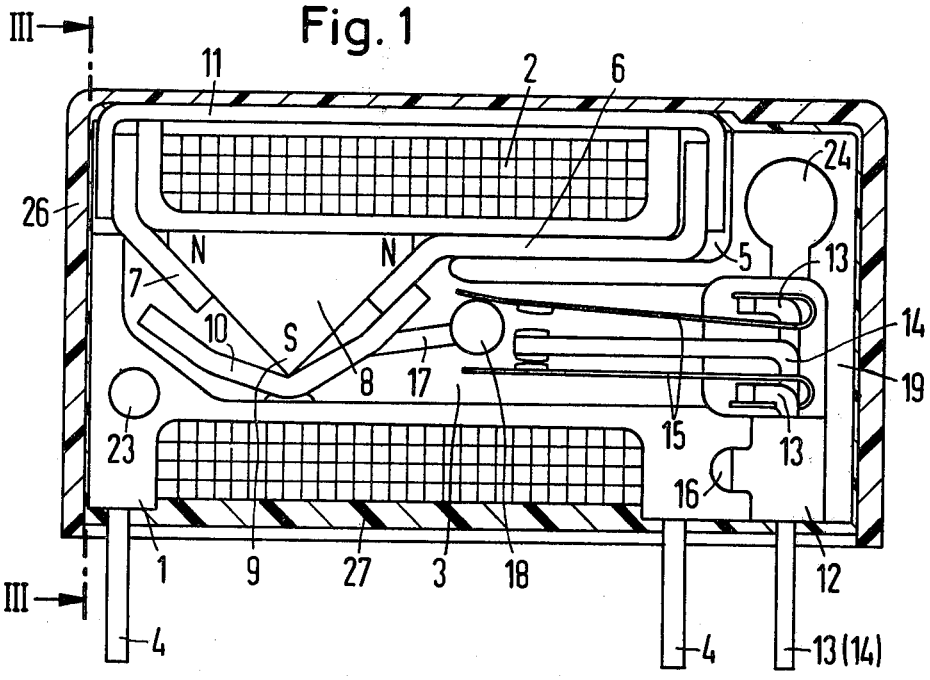
FIG. 1 is a cross section of a polarized relay constructed according to this invention, the section taken axially of the coil winding along the lines I—I of FIG. 3.
Figure 3:
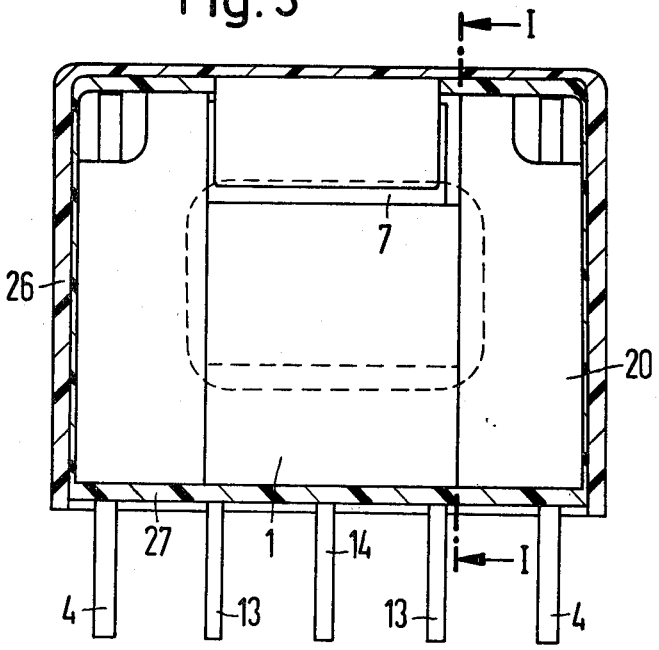
FIG. 3 is a section taken along the lines III—III of FIG. 1.

FIG. 1 is a cross sectional view of a miniature polarized relay according to this invention illustrating the switching chamber interior of the coil winding main body portion, the section being taken, as illustrated in FIG. 3, at approximately a line of joinder of the cover portion of the coil body. All of the relay components are carried by the main body portion 1 which is constructed of insulating material and which forms a coil winding body for the coil 2. The body defines an interior switching chamber 3 which is initially opened at one side for later closure by the cover portion of the winding body. One or more terminal pins 4 for the coil winding are injection molded into the main body while all other components, i.e. the magnet system and the contact unit, are inserted into the switching space 3 defined within the main body. The direction of insertion is perpendicular to the plane of the section illustrated. In order to provide designated areas for receipt of the components, the switching chamber 3 is provided with guide channels 5 which extend in the direction of insertion and are formed as wall configurations of the main body. The guide channels 5 accommodate the pole plates 6 and 7 of the magnet system. The magnet system illustrated utilizes a three pole permanent magnet 8 which has an approximately triangular cross section and is positioned between the ends of the pole plates 6 and 7 which converge towards one another in an approximate V shape. The central edge 9 of the triangular permanent magnet 8 forms a knife bearing edge for an armature 10 which is capable of rocking on the edge 9. The magnetic circuit from the permanent magnet 8 is closed by a flux plate 11 which is attached to join the pole plates 6 and 7 after the winding of the coil 2.

In the embodiment illustrated in FIG. 1 a single contact unit is provided in the switching space 3 and consists of an insulating block 12 which is formed with injection molded contact spring carriers 13 and a stationary contact carrier 14. Contact springs 15 project from the carriers 13 and are biased in relation to the centrally positioned stationary contact 14. The springs 15 may be welded to the carriers 13. In other embodiments the springs could themselves be injection molded into the insulating block 12 or otherwise attached. The insulating block 12 is received in a contoured guide channel 16 formed in the main body 1 and extending in the same direction as the guide channels 5 for the pole plates and magnet. This use of parallel guide channels avoids tolerance problems with respect to accurate positioning of the contact units. The actuating stud 18 affixed to an armature arm 17 is of cylindrical design so that its axis runs parallel with the direction of insertion of the components. In this design, any slight difference in the depth of insertion will not effect the contact operation.

Although in FIG. 1 the guide channel for the insulating block of the contact unit is illustrated as being positioned in the bottom or base wall of the main body 1 such that the terminals 13 and 14 of the contact unit will project parallel to the terminals 4 of the coil winding, if desired the guide channel can be formed in the end wall 19 of the main body in which case the terminals 13 and 14 would have to be bent down towards the terminal or base side of the relay.

Following assembly of the components in the switching chamber, it is possible to test and correct the functioning of the relay prior to closure of the switching chamber and winding of the coil winding 2. For this purpose an externally connected magnetic field may be utilized in juxtaposition to the partially assembled relay. Any adjustment of the contacts which may be required as easily accomplished due to the open nature of the partially assembled relay.

Following assembly, and any adjustment, the open side of the switching chamber 3 is closed off with a cover portion of the coil body. The cover portion is designed in such a way that, together with the main body 1, it will form a completed coil body for application of the winding 2.

Figure 2:
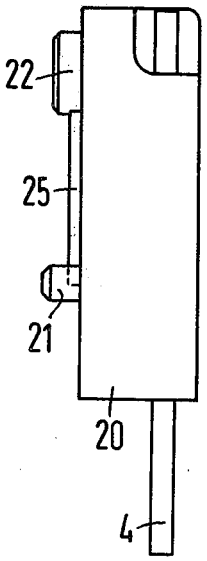
FIG. 2 is an end plan view of a cover or second portion of the coil winding body.

FIG. 2 illustrates a cover body portion 20 of the aforementioned type which is injection molded and includes attachment pegs 21 and 22 which are to be inserted into corresponding openings 23 and 24 formed in the main body 1. Further illustrated is a brace projection 25 which centers the cover and prevents deformation of the switching chamber 3. In order to avoid redundancy in positioning, the openings or sockets 23 and 24 for the pegs 21 and 22 are preferably provided with a cross section which differs from the cylindrical shape of the pegs 21 and 22 thereby allowing tolerance variations. In the embodiment illustrated the socket 24 may be open to the switching chamber 3 and since it is not filled by the peg 22, it can serve, for example, to accommodate a getter.

Further, although FIG. 1 illustrates both terminal pins 4 for the winding as being formed in the main body portion 1, one or more of the terminal pins can be formed in the cover portion 2 as illustrated in FIG. 2.

FIG. 3 is an end view of the relay of FIG. 1 as closed by the cover of FIG. 2 taken along the lines III—III of FIG. 1. After assembly of the relay and winding of the coil, protective cap 26 formed of insulating material can be assembled over the entire unit with the interspaces between the cap and the coil winding being filled with a sealing compound 27. Because the switching space is closed by the cover 20, the sealing compound will not penetrate into the switching chamber.

FIG. 1 illustrates a simple embodiment having a single contact unit however the same basic concept can be provided with two or four contact units by parts duplication while retaining the insertion and assembly principles of this invention.

Figure 4:
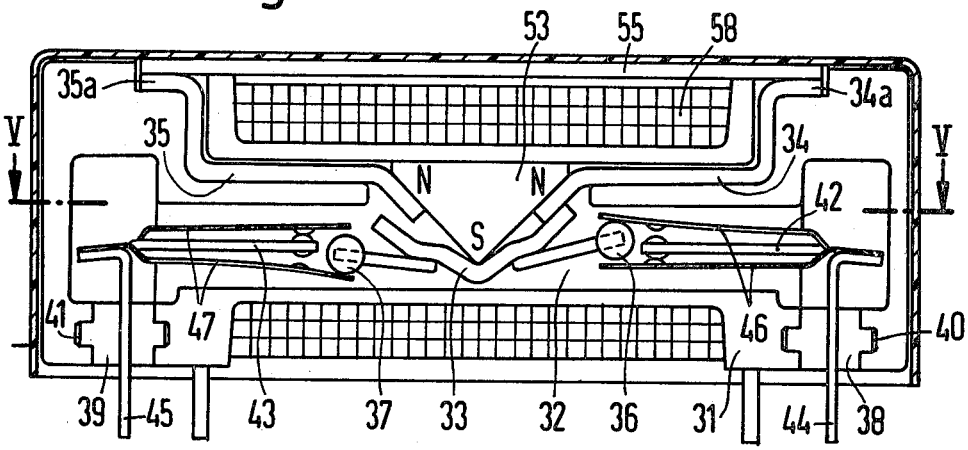
FIG. 4 is a view similar to FIG. 1 illustrating a modification of the relay of this invention.

Thus, as illustrated in FIG. 4, which is a cross section view similar to FIG. 1, a main body portion 31 can be provided defining a switching chamber 32 which is extended or longer than the switching chamber illustrated in FIG. 1 and which is formed substantially as a mirror image of a plane passing through the bearing axis of the armature 33 penpendicular to the longitudinal axis of the relay. Pole plates 34 and 35 are designed to be correspondingly symmetrical and the armature is also symmetrically provided with two actuating armature arms and actuating studs 36,37. Two contact units 38 and 39 which are likewise symmetrically arranged are inserted into two guide channels 40 and 41. Each of the contact units is equipped with a stationary central contact 42 and 43 and two spring contact carriers 44 and 45 which are welded to contact springs 46 and 47.

Figure 5:
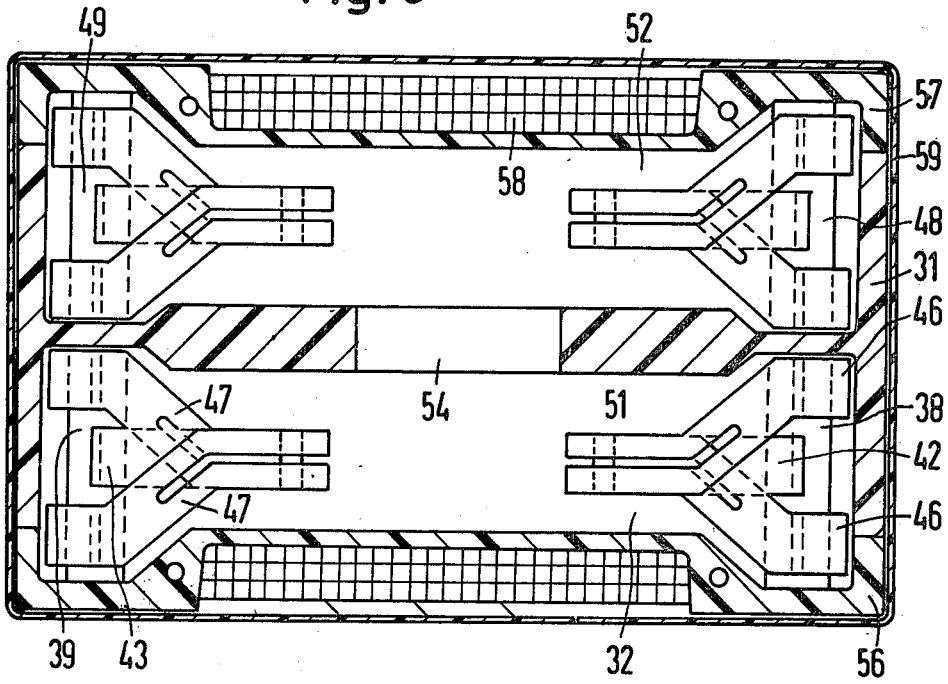
FIG. 5 is a cross sectional view taken along the lines V—V of FIG. 4.

The design of FIG. 4 can be duplicated to accommodate four contact units by providing a main body portion which defines parallel switching spaces identical to the single switching space illustrated in FIG. 4. Such an extended design, illustrated in FIG. 5 has a main body portion 31 provided with a second switching chamber 52 which is identically formed with the switching chamber 32 and is spaced therefrom by a wall 51 forming a rear wall of the switching chamber 32 which receives the contact units 38 and 39. The switching chamber 52 receives identical contact units 48 and 49. FIG. 5 does not illustrate the magnet system however in the embodiment illustrated in FIG. 5 a common armature 33 and a common permanent magnet 53 as shown in FIG. 4 can extend across the entire width of both of the switching chambers 32 and 52. Thus the wall 51 is provided with a corresponding opening 54. It is of course to be understood that the switching chamber 52 will be formed with guide channels for pole plates which correspond to the pole plates 34 and 35 of the chamber 32. The components, including the pole plates, and the contact units of the chamber 52 will be inserted from the opposite side from the insertion of the components of the chamber 32 and the pole plates will aid in imparting stability to the main body 31. The flux plate 55 positioned above the coil winding 58 can be common to both switching chambers. In the embodiment illustrated in FIG. 4, the pole plates 34 and 35 are shown as being flanged outwardly at their ends 34*a* and 35*a* respectively to extend in a plane parallel to the coil axis. In this construction the flux plate 55 rests flat thereby allowing length variances in the pole and flux plates without effecting the flux field. As is illustrated in FIG. 5 each of the switching chambers 32 and 52 will be closed by a separate cover 56 and 57 respectively to which a common coil winding 58 is thereafter applied. As in FIG. 1 the relay is again provided with a protective cap 59 and filled with casting compound.

Figure 6:
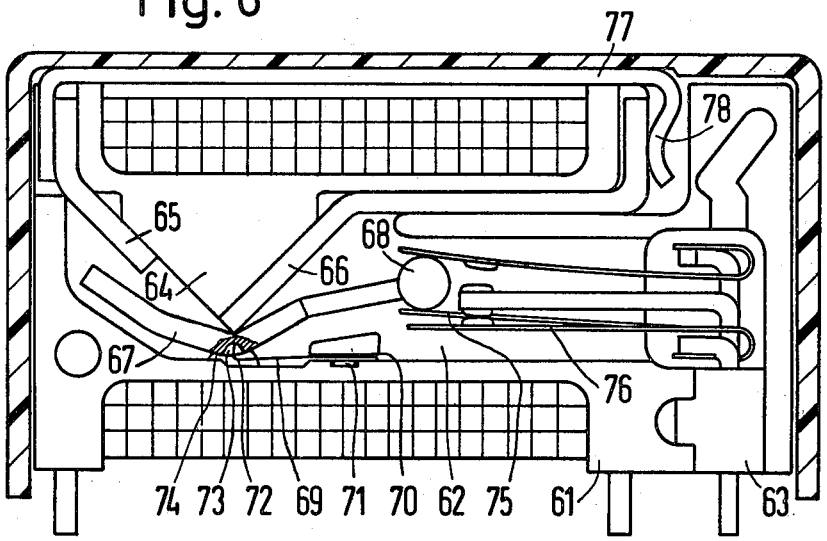
FIG. 6 is a view similar to FIGS. 1 and 4 illustrating a nonpolarized embodiment of the relay of this invention.

FIG. 6 illustrates a modification of the relay of FIG. 1 involving a nonpolarized embodiment. In this instance the switching chamber 62 of the main body 61 and the contact unit 63 are constructed fundamentally the same as in FIG. 1. However the permanent magnet is eliminated and in its place the main body is formed with a rib member 64 having angled walls against which pole plates 65 and 66 rest. The pole plate 66 is longer than in FIG. 1 and has an end edge which forms the bearing for the armature 67 which is again approximately V shaped. The armature 67 has a cylindrical actuating stud 68.

Since the permanent magnet is not provided in this embodiment, the armature will be pressed against the knife edge bearing by a pressure spring 69. As is the case with the other components, the pressure spring will be inserted into a guide channel 70 formed in the main body portion. The pressure spring is secured by lugs 71. The tip 72 of the spring 69 is received in a groove 73 in the armature 67. Displacement of the armature in the direction of its axis of rotation is prevented by shoulder 74 formed on the rear wall of the main body portion and by a corresponding shoulder formed on the wall of the cover portion (not shown). The armature is reset by means of a return spring 75 which, in the embodiment illustrated, is formed as a split off section of the contact spring 76. FIG. 6 also illustrates another modification in the contact between the pole plates 66 and 65 and the flux plate 77. At one end 78, or both ends if desired, the flux plate 77 is provided with an S shaped bend providing a spring contact with the pole plate.

Figure 7:
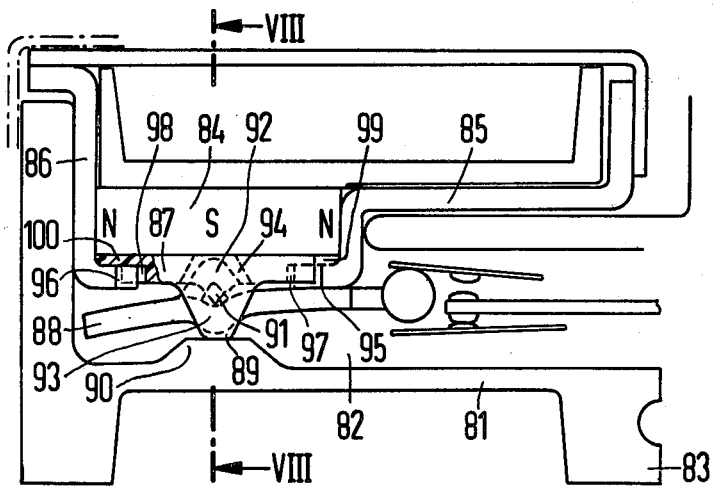
FIG. 7 is a partially diagrammatic view illustrating a polarized relay having a modified magnet system.
Figure 8:
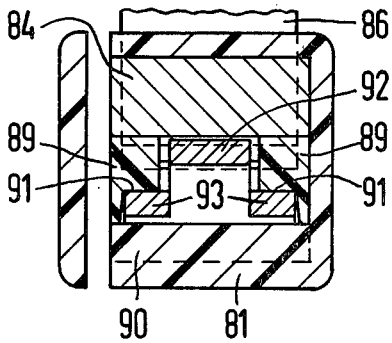
FIG. 8 is a fragmentary cross sectional view taken along the lines VIII—VIII of FIG. 7.

FIG. 7 illustrates a further modification shown in connection with a polarized relay. Once again the main body portion 81 is formed with a switching chamber 82 and a contact unit 83 substantially similar to those illustrated previously. However in place of the permanent magnet of triangular cross section which is shown in prior embodiments, a bar magnet 84 is provided which has been magnetized in standard three polar fashion. Pole plates 85 and 86 are correspondingly modified in their structure to contact the ends of the bar magnet. A nonmagnetic bearing and spacing pad 87 surrounds the armature 88 in an approximate U shape and provides the armature bearing. The upper side of the component 87 rests against the permanent magnet. The pad 87 has spaced apart side portions 89 thereof which contact an elevation 90 of the main body providing assurance of proper height dimensioning for the switching chamber 82. The side portions 89 form a knife edge bearing 91 for the armature 88 which, in its center is provided with a reverse bend or broken away portion 92 having bent arms 93 on each side thereof which form the bearing groove for the armature. The broken away portion or reverse bend portion 92 forms a flux guiding component of the armature and engages in a recess 94 of the bearing component 87 and projects close to the central pole of the permanent magnet without touching the same.

During assembly of the magnet system, the pole plates 85 and 86 are each secured to the insides of the permanent magnet 84 by means such as, for example, spot welding. Their somewhat offset ends 95 and 96 each engage in a form locking or structure stabilizing fashion in recesses 97 and 98 of the component 87. The component 87 therefore also defines the precise distance to the permanent magnet by means of projections 99 and 100 which underlie the bar magnet. The armature 88 is inserted by an upward movement into the bearing component 87. Thereafter the entire magnet system can be inserted in the previously described fashion into the switching chamber 82 of the main body 81. Although FIG. 7 illustrates a single contact unit, as is common with the prior described embodiments the contact unit can be duplicated to provide multiple contact assemblies.

It can therefore be seen from the above that our invention provides a miniature electromagnetic relay constructed of a coil winding main body portion open at one side thereof defining an interior switching space and being equipped with formed in place guide channels for receipt of switching and magnetic components into the switching space. The switching space is closed by a cover portion of the coil winding body which defines the winding area for the relay.

Although the teachings of our invention have herein been discussed with reference to specific theories and embodiments, it is to be understood that these are by way of illustration only and that others may wish to utilize our invention in different designs or applications.

We claim as our invention:

1. In a miniature electric relay having a coil winding body constructed of at least two parts defining an interior switching space, containing a switching system including an armature movable in a plane and an electric contact set which includes at least two contact carrying members at least one of which is movable under influence of the armature, the improvement of: the body being split into the at least two parts longitudinally of the coil axis, one of said body parts having an internal configuration defining a substantial portion of said switching space, said internal configuration defining guide channels for receipt of switching system components including a contact set mounted to a base block, the base block insertable into one of the guide channels, the switching space of said one of said body parts being open along a side thereof and the direction of insertion of the components being normal to the plane of armature movement.

2. The relay of claim 1 wherein components of an armature assembly including flux guide plates are received in additional guide channels and wherein the guide channels support the components received therein in proper operating position with respect to one another without closure of the switching space by a second of said two parts whereby operation of said relay can be checked prior to closure of the coil winding body.

3. A miniature relay comprising a coil body having at least two parts which enclose contact making elements received within a switching chamber therein, one of said body parts comprising a main body forming substantial portions of said switching chamber the other of said body parts comprising a cover portion for closing said switching chamber, the main body part having switching chamber associated wall configurations defining guide channels into which parts of an armature movement system for said relay and at least one contact unit can be inserted in parallel relation to one another from a side of the switching chamber with the direction of insertion being perpendicular to the plane of movement of an armature received in the switching chamber, the guide channels properly positioning received components within the switching chamber.

4. A relay of claim 3 wherein coil winding terminal pins are injection molded into at least one of the coil body parts.

5. A miniature relay comprising a coil body having at least two parts which enclose contact making elements received within a switching chamber therein, one of said body parts comprising a main body forming substantial portions of said switching chamber the other of said body parts comprising a cover portion for closing said switching chamber, the main body part having switching chamber associated wall configurations defining guide channels into which parts of an armature movement system for said relay and at least one contact unit can be inserted in parallel relation to one another from a side of the switching chamber with the direction of insertion being perpendicular to the plane of movement of an armature received in the switching chamber, the guide channels properly positioning received components within the switching chamber, wherein each contact unit includes an insulating block receivable in the guide channel in close fit relationship, the insulating block having at least one spring carrier and at least one stationary carrier injection molded therein, the spring carrier having a movable contact equipped spring affixed thereto and the stationary carrier having at least one stationary contact affixed thereto.

6. A relay according to claim 5 wherein the carriers of the contact unit are positioned in line in the insulating block in the direction of insertion of the block into the guide channel and at least one of the contact carriers and the contact equipped members carried thereby are offset in such a way that the contacts overlap one another at a contact position interior of the switching space when the insulating block is received in the guide channel.

7. A relay according to claim 5 wherein the guide channels are provided for receipt of contact units are positioned in a base wall of the main body part, said base wall having all relay terminals projecting therefrom.

8. A relay according to claim 5 wherein the base body part has guide channels formed therein for receipt of the contact units arranged in an end wall of the base body part.

9. A relay according to claim 3 wherein at least two contact unit guide channels are provided in the main body part parallel to one another, contact units received in each of the contact unit guide channels inserted parallel to one another having contact carrying members extending towards one another parallel to the coil axis, and the contacts of each of said units being operated by a common armature positioned between said units.

10. A relay according to claim 3 wherein two contact units are received in a single guide channel.

11. A relay according to claim 9 wherein at least two contact units are received in one of said guide channels.

12. A relay according to claim 3 wherein the main body part defines two parallel switching chambers each open to an opposite side of the main body part and each closeable by a separate cover body part, each switching chamber including main body part defined guide channels for receipt of at least one contact unit in each switching chamber.

13. A relay according to claim 3 including a magnet system, said magnet system including two pole plates received in pole plate guide channels defined in the main body, said pole plates having end portions converging towards one another in a V shape, a knife edge bearing lying at approximately the point of insection of planes of projection of the ends of the pole plates, a rocker armature having an approximate V shape pivoting on said knife edge bearing.

14. A relay according to claim 13 wherein a permanent magnet is received between the ends of the pole plates, the permanent magnet having substantially a triangular cross section having one edge forming the knife edge bearing for the armature, the said one edge having a first polarity, said magnet having two other edges, said two other edges contacting the pole plates and possessing a second polarity opposite the first polarity.

15. A relay according to claim 13 wherein the main body includes a bearing rib extending between the ends of the pole plates.

16. A relay according to claim 13 wherein the armature has at least one actuating arm projecting therefrom terminating in an actuating stud having an axis running parallel to the direction of insertion of the components into the guide channels.

17. A relay according to claim 13 wherein the armature is pressed against the knife edge by means of a pressure spring.

18. A relay according to claim 17 wherein the pressure spring is received in a pressure spring guide channel defined in the main body part.

19. A relay according to claim 18 wherein the switching space is closed at one side by a main body wall, said wall and a wall defined in said cover each having shoulders formed therein projecting therefrom, said shoulders maintaining the armature in alignment in the plane of movement.

20. A relay according to claim 13 wherein a contact spring of the contact unit includes a free spring portion thereof, the free spring portion engaging said armature and functioning as a return spring for said armature.

21. A relay according to claim 12 wherein a common armature is provided for both switching chambers.

22. A relay according to claim 21 wherein a common permanent magnet is provided for both switching chambers.

23. A relay according to claim 3 including a magnet system having a bar magnet positioned parallel to the coil axis having two ends of similar polarity connected to pole plates, the armature being mounted adjacent a central portion of the bar magnet, the central portion having a polarity opposite the ends.

24. A miniature relay comprising a coil body having at least two parts which enclose contact making elements received within a switching chamber therein, one of said body part comprising a main body forming substantial portions of said switching chamber the other of said body parts comprising a cover portion for closing said switching chamber, the main body part having switching chamber associated wall configurations defining guide channels into which parts of an armature movement system for said relay and at least one contact unit can be inserted in parallel relation to one another from a side of the switching chamber with the direction of insertion being perpendicular to the plane of movement of an armature received in the switching chamber, the guide channels properly positioning received components within the switching chamber, including a magnet system having a bar magnet positioned parallel to the coil axis having two ends of similar polarity connected to pole plates, the armature being mounted adjacent a central portion of the bar magnet, the central portion having a polarity opposite the ends, wherein a non-magnetic bearing member is provided adjacent the central portion of the bar magnet, the non-magnetic bearing member having an approximately U shape cross section having free leg ends forming a knife edge for an armature.

25. A relay according to claim 24 wherein the armature has a reverse bend central portion projection towards the permanent magnet and terminating in spaced relation thereto.

26. A relay according to claim 24 wherein the bearing member is supported on a base wall of the main body portion.

27. A relay according to claim 26 wherein the bearing member abuts ends of the pole plates of the bar magnet in a form locking member.

28. A relay according to claim 27 wherein the bearing member has projections which define the distance between the ends of the pole plates and the permanent magnet, the ends of the pole plates extending along the underside of the permanent magnet.

29. A relay according to claim 3 wherein at least one flux plate is provided extending over the coil body and over a coil winding wrapped around the coil body, the flux plate engaging ends of pole plates received in guide channels in the main body portion.

30. A relay according to claim 29 wherein the flux plate is a flat plate contacting outwardly flanged ends of the pole plates.

31. A relay according to claim 29 wherein the flux plate has at least one end thereof bent as a spring section resiliently engaging a pole plate.

32. A relay according to claim 3 wherein the cover part is provided with projections indexing in sockets formed in the main body part.

33. A relay according to claim 3 including a protective cover received over the coil body.

34. A relay according to claim 33 wherein a sealing compound fills the interspaces between the protective cover and the coil body.

* * * * *